US006342030B1

(12) United States Patent
Lazik

(10) Patent No.: US 6,342,030 B1
(45) Date of Patent: Jan. 29, 2002

(54) DEVICE FOR CLIMBING AND/OR BALANCE TRAINING

(76) Inventor: Dieter Lazik, Am Molkenberg 9, 14778 Radewege (DE)

( * ) Notice: Subject to any disclaimer, the term of this patent is extended or adjusted under 35 U.S.C. 154(b) by 0 days.

(21) Appl. No.: 09/367,975

(22) PCT Filed: Feb. 24, 1998

(86) PCT No.: PCT/DE98/00576

§ 371 Date: Aug. 24, 1999

§ 102(e) Date: Aug. 24, 1999

(87) PCT Pub. No.: WO98/36804

PCT Pub. Date: Aug. 27, 1998

(30) Foreign Application Priority Data

Feb. 24, 1997 (DE) ..... 197 08 705

(51) Int. Cl.[7] ..... A63B 69/00
(52) U.S. Cl. ..... 482/37
(58) Field of Search ..... 402/35–43

(56) References Cited

U.S. PATENT DOCUMENTS 4,183,521 A 1/1980 Kroeker
5,543,185 A * 8/1996 Christensen ..... 428/15

FOREIGN PATENT DOCUMENTS

DE 3815564 11/1989
EP 0329585 * 8/1909 ..... 482/37
EP 0424569 * 5/1991 ..... 482/37
FR 2692488 12/1993
FR 2713493 6/1995
FR 2713494 6/1995
FR 2730643 8/1996
JP 6-7469 * 1/1994
WO 8909635 10/1989
WO 9111226 8/1991

* cited by examiner

*Primary Examiner*—John Mulcahy
(74) *Attorney, Agent, or Firm*—Birch, Stewart, Kolasch & Birch, LLP

(57) ABSTRACT

The invention describes a piece of equipment for climbing and/or balance training with adjustably arrangeable climbing grips or with an adhesion-friction coating, which consists of a flat disk on a holding system, and the disk design provides for rotating and/or tipping of the disk. By means of a guide element with rollers and/or grooves, the disk is mounted with the ability to rotate, and the rotation resistance can be varied with an adjustable brake device that is part of a mechanical brake system. In addition, with another free rotational axis, the angle of inclination of the disk can be modified, and/or by releasing the plug-in connections a combined rotating and tipping movement is made possible. Also, the rotating and tipping movements of the disk as well as the adjustments of the brake resistance can be predetermined with a programmable motor control. On the disk are openings that receive the plug-in devices for the climbing grips, the distribution of which is flexible in accordance with user preferences.

12 Claims, 2 Drawing Sheets

DEVICE FOR CLIMBING AND/OR BALANCE TRAINING

Figure 2:
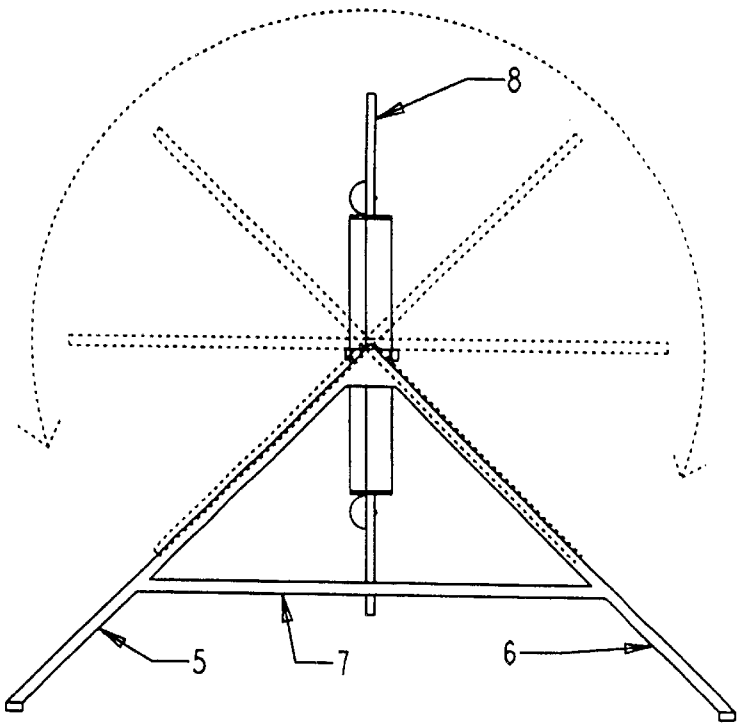

This application is the national phase under 35 U.S.C. §371 of PCT International Application No. PCT/DE98/00576 which has an International filing date of Feb. 24, 1998 which designated the United States of America.

DESCRIPTION

The invention relates to a piece of equipment for climbing and/or balance training with adjustably arrangeable climbing grips or coatings; and the equipment finds use in training applications in the home, in fitness centers and in professional sports.

The market sector leisure and fitness is currently showing pronounced changes in the nature of sports activities. In fact, alternative athletic disciplines such as climbing, also referred to as 'free climbing,' are gaining more and more in importance. Fitness clubs are increasingly concerned with satisfying this trend, even though most athletic locations are bound by considerable limitations to this end. Accordingly, general athletic equipment to date does not offer specific exercises for climbers, and only very few fitness facilities have the means and opportunity to install climbing walls that are known in the art. It is disadvantageous that these climbing walls known in the art require much space, and that they are expensive.

Equipment for climbing training with adjustably arrangeable climbing grips has previously been known in the art from WO89/09635. In this instance, a flat disk is arranged on a holding system, and the disk can be rotated or tipped. To a certain degree, this design already provides for the possibility of individual adjusting of the climbing surface.

These and other objects are accomplished by equipment for climbing and/or balance training with adjustably arrangeable climbing grips, wherein a flat disk is arranged on a holding system, and the flat disk is capable of being simultaneously rotated and tipped.

In contrast to climbing walls already in existence, the present invention is a flexible system which is independent of location, satisfies a high athletic standard, is maintenance-free, and which is considerably less expensive than climbing walls. Consequently, with the equipment according to the invention, high quality training is possible even at athletic facilities with limited space.

A particular advantage of the invention is the space-saving construction of the equipment as well as the variety of possible training regimens. The latter is accomplished by arranging a flat disk with holding grips, or a coating, on a holding system, and this disk is designed with rotating and/or tipping properties. Provided on the holding system is, directly or indirectly, a guide element for the rotating holding support and mounting of the disk, and/or an adjustment element for the realization of tipping movements performed by the disk.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Subsequently, the invention will be explained in more detail with the assistance of the embodied examples that are at least in part depicted in the figures.

Figure 1:
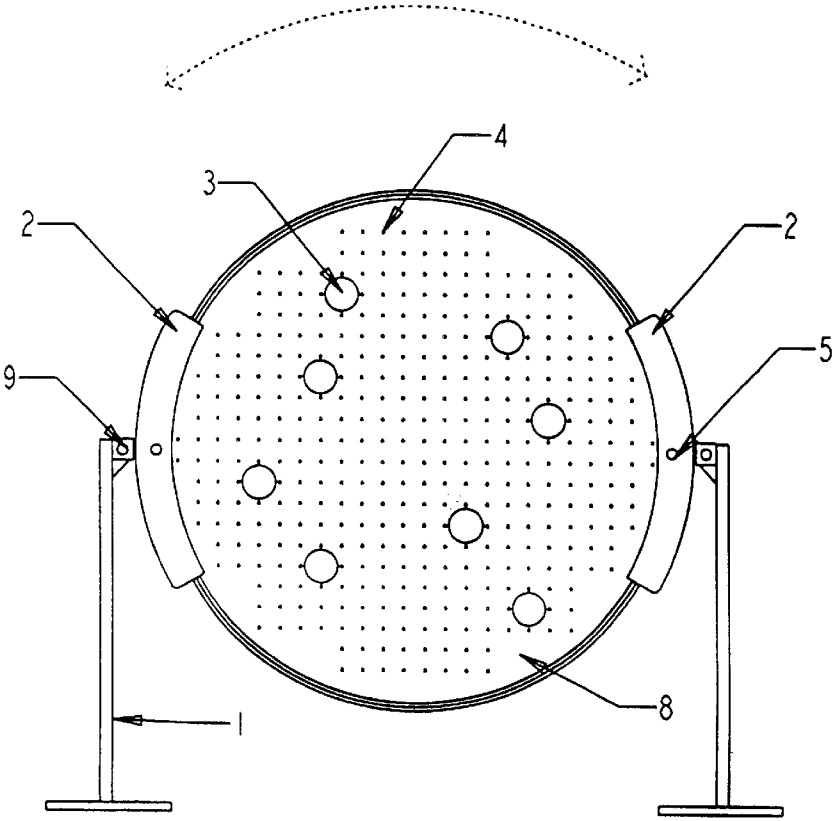
Figure 3:
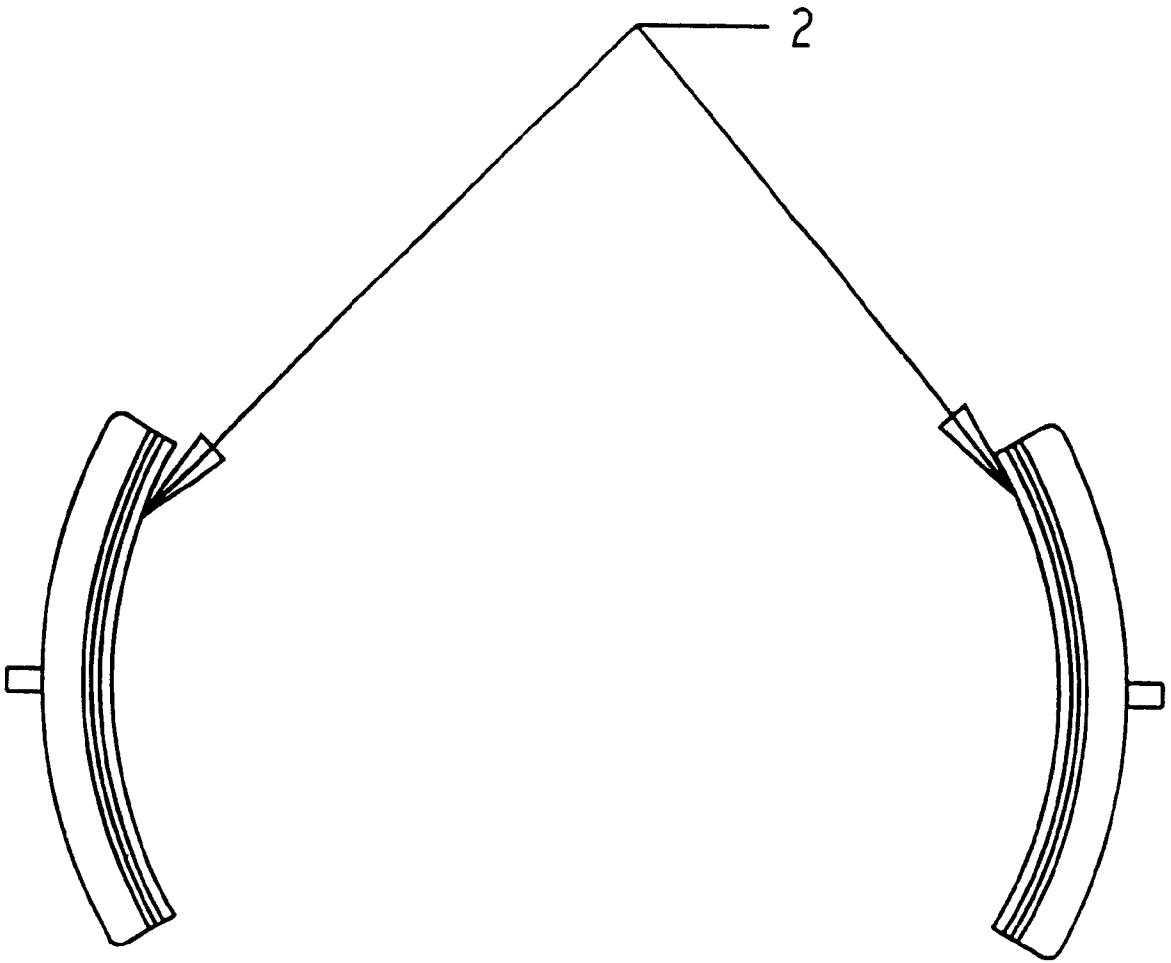

They show:

FIG. 1 An illustration of the principle embodied in the equipment with selected climbing grips FIG. 2 A stylized side view with respect to FIG. 1 indicating various tipping positions FIG. 3 A detailed view of the guide element for the disk.

As shown in FIG. 1, the climbing and balance training system consists of a holding system 1 which contains the disk 8. This disk 8 has a diameter of approximately 2 m. Using rollers and/or groves, it is mounted with the ability to rotate by means of the guide element 2 on the holding system 1, and the rotation resistance can be varied with an adjustable brake device that is part of a mechanical brake system. In addition, with another free rotational axis, the angle of inclination of the disk 8 can be modified, and/orby releasing the plug-in connections a combined rotating and tipping movement is made possible. The openings 4 are located on the disk 8 for the purpose of receiving the plug-in devices for the climbing grips 3 the distribution of which is flexible according to user preferences. The disk 8 can be manufactured of a magnetic material, designed without bore holes, and the climbing grips can be adjustably arranged on the disk 8 with magnetic force. The same principle can be applied with regard to metallic wall mirrors or other surfaces occurring e.g. in the fitness area.

It is also possible to design the disk 8, or certain surfaces, as smooth and even, while the climbing grips 3 are adjustably fastened to the disk 8 with the assistance of suction cups or suction fastening devices Moreover, it is also possible to forego the climbing grips altogether. Instead the disk is equipped with a coating for the purpose of realizing adhesion and friction forces between the body of the climber and the disk 8. The coating can consist of, for example, plastic or alkyd resin, and it can be applied directly onto the disk or it can be screwed on as a membrane. Different types of coatings provide for variety in terms of climbing difficulty.

Depending on his/her level of fitness, the user can train his/her motor skills and expertise at different angles of attack. Consequently, for the first time, with this equipment it is possible to simulate overhanging rock, inclined planes or roof-like climbing challenges. Because of the different ways in which the equipment can be moved, it is possible to very favorably target specific strength, endurance and balance training goals. By rotating the disk 8 during the actual training process the climber is able to practice diagonally, sideways, and in extreme cases even upside down, which in part corresponds to training in natural surroundings. The rotating movements and the braking processes of the disk 8 can be adjusted mechanically or with a motor, e.g. an electric motor with the corresponding controls. If a motor control is used, it is possible to load programs that represent certain levels of difficulty which, as a consequence, constantly change the system. For example, the position of the disk 8 can be changed every 10 seconds by rotating and/or tipping the disk, or the disk's movability can by modified with changes of the braking power.

In simple embodiments of the equipment the tipping position of the disk 8 is arrested with a plug-in connection, for example, a bolt that is plugged into the adjustment element 9. T-screws can be used as a simple brake mechanism for slowing down the rotating movement of the disk 8. The fastening of the climbing grips 3 on the disk 8 can be effected by inserting them into the openings 4, by screwing them on, with magnetic force or any other suitable fastening method. The climbing grips 3 can be arranged on both sides of the disk 8. In addition, it is possible to install climbing grips 3 on one side of the disk 8 and to equip the disk 8 with an adhesion-friction coating on the other side. In the present embodiment the holding system 1 is envisioned as a two-piece support with, respectively, two support braces 5 and 6, arranged at an angle in relation to each other, and a cross brace 7, and the angle between the support braces 5 and 6 is approximately 90 degrees.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention is not limited to the embodiments that are described in the current context. Rather, by combining the means and characterizing features, which have been referred to here, it is possible to realize other variations of embodied examples without exceeding the framework of the invention.

List of Designations

1 Holding system
2 Guide element for the disk
3 Climbing grips
4 Openings
5 Support brace
6 Support brace
7 Cross brace
8 Disk
9 Adjustment element

What is claimed is:

1. A climbing and/or balance training device with adjustably arrangeable climbing grips, said device comprising:

a flat disk arranged on a holding system, wherein said flat disk is arranged to simultaneously produce a rotating motion about its axis and a tipping motion;

a guide element directly or indirectly arranged on said holding system, said guide element providing a rotating, holding support mount for said flat disk;

an adjustment element arranged on said holding system for producing said tipping motion; and an adjustable brake device arranged on either of said adjustment element or said guide element.

2. The device according to claim 1, wherein said adjustable brake device comprises at least one T-screw.

3. The device according to claim 1, wherein said flat disk is connected to at least one driving force for causing said rotation and tipping motions of said flat disk, said driving force produced by means of at least one electric motor, and each electric motor is controlled by a programmable motor control.

4. The device according to claim 1, wherein the tipping motion of said disk is arrested with plug-in connections on the adjustment element.

5. The device according to claim 1, wherein the rotating, holding support mount of the flat disk is effected by means of groove and/or roller guiding between the flat disk and the guide element.

6. The device according to claim 1, wherein the flat disk is equipped on at least one side with a multitude of openings for the optional fastening of climbing grips.

7. The device according to claim 1, wherein the flat disk is constructed of a magnetic material and the climbing grips are equipped with magnets for attaching to the flat disk.

8. The device according to claim 1, wherein the flat disk includes a smooth, even surface while the climbing grips are equipped with suction fastening devices for attaching to the flat disk.

9. The device according to claim 1, wherein the flat disk is constructed in a circular shape.

10. The device according to claim 1, wherein the holding system includes a two-piece support having first support brace and a second support brace arranged at an angle in relation to each other, and a cross brace that connects said first and said second support braces, and an angle between the first and second support braces is approximately 90 degrees.

11. The device according to claim 1, wherein:

the flat disk is equipped with a coating supporting adhesion and friction forces.

12. The device according to claim 11, wherein the coating consists of plastic and/or alkyd resin in order to realize different levels of training difficulty.

* * * * *